US005586811A

United States Patent [19]

Tornero

[11] Patent Number: 5,586,811

[45] Date of Patent: Dec. 24, 1996

[54] ADJUSTMENT DEVICE FOR CHAIR ARMS

[76] Inventor: Lino E. Tornero, 809 Quailmeadow La., Colfax, N.C. 27235

[21] Appl. No.: 289,578

[22] Filed: Aug. 15, 1994

[51] Int. Cl.[6] ..... A47C 7/54

[52] U.S. Cl. ..... 297/411.36; 297/115; 248/295.11; 403/108; 403/110

[58] Field of Search ..... 297/411.36, 115, 297/161, 383, 410, 411.37; 248/298, 295.1, 920, 424; 403/108, 110, 107, 106

[56] References Cited

U.S. PATENT DOCUMENTS

| | | | |
|---|---|---|---|
| 2,957,601 | 10/1960 | Novick . | |
| 3,214,057 | 10/1965 | Box . | |
| 3,672,530 | 6/1972 | Bridenstine et al. . | |
| 3,720,443 | 3/1973 | Mourgue . | |
| 4,036,525 | 7/1977 | Howk | 297/353 |
| 4,042,127 | 8/1977 | Brossia . | |
| 4,183,491 | 1/1980 | Sanders et al. . | |
| 5,011,011 | 4/1991 | Kidd . | |
| 5,082,328 | 1/1992 | Garelick | 297/344 |
| 5,205,410 | 4/1993 | Kuipers et al. . | |
| 5,324,096 | 6/1994 | Schultz | 297/411.36 |
| 5,338,133 | 8/1994 | Tornero . | |
| 5,388,892 | 2/1995 | Tornero | 297/411.36 |

FOREIGN PATENT DOCUMENTS

| | | | |
|---|---|---|---|
| 2518216 | 12/1981 | France . | |
| 199402 | 8/1938 | Switzerland | 297/115 |
| 2191686 | 12/1987 | United Kingdom | 248/424 |

*Primary Examiner*—Laurie K. Cranmer

[57] ABSTRACT

An adjustment device is provided for selectively positioning a structural member as for example, an office chair arm relative to the seat. The device includes a planar support member and a retaining member which are joined to encase a bearing through which a slidable structural member is adjusted. A detente element in the bearing engages one of a plurality of apertures in the structural member to allow the structural member to be releasably locked in a selected position. The adjustment device can be used on other members which slide for ease and convenience during positioning.

8 Claims, 3 Drawing Sheets

ADJUSTMENT DEVICE FOR CHAIR ARMS

BACKGROUND OF THE INVENTION

Field of the Invention

The invention herein pertains to slidable adjustment devices and particularly to adjustment devices for furniture such as for chair arms as may be releasably adjusted without need of manual actuating levers.

Background and Objects of the Invention

The present invention relates in general to devices which provide for the selective adjustment and positioning of movable structural components relative to one another. As will be seen, the device herein is ideally suited for use in furniture, particularly office furniture, where the current market emphasis on ergonomic design calls for adjustable furniture structures such as used with certain chairs that can be adjustably positioned to fit different individuals with various height, weight and job tasks.

Primarily the adjustment device is intended for the positioning of components where frictional locking means is sufficient and load forces moderate, such as chair arms, but where it is desirable to avoid the use of manual friction inducing levers or other locking members. Here the adjustment device can be used to laterally position the arms of a chair to accommodate users of different body widths. In the prior art, chair arm lateral adjustment has been accomplished by means of structural members or "J-BARS" provided with elongated slots and bolted to the undercarriage or seat pan of the chair. One type of adjustment was accomplished by reaching under the chair with a specialized tool or wrench and loosening or tightening several bolts. Another type of adjustment, such as is the subject of my U.S. Pat. No. 5,338,133, Ser. No. 08/026,602 for the loosening or tightening by means of a lever which frictionally locks in one position or another. While the latter method was practical and effective it has the disadvantage of the presence of the actuating lever that tends to clutter the underside of the chair seat, where one already finds numerous levers pertaining to the adjustment of other mechanisms on the chair. It has been found, that chair arms are normally subject to stress loads (such as by the occupant's arms), in any position of lateral adjustment, perpendicular to the chair seat. Little or no horizontal loads act on the chair arms. Therefore it is felt that it would be possible and highly desirable to obtain positioning of the chair arm without the need for a conventional "locking" function, and that all that is needed is the ability to laterally adjust the position of the arms and provide only for a simple "detente" in any of several arbitrarily chosen positions, thus eliminating the need for a "locking lever".

The device and object of the present invention provides for quick manual positioning of one structural member relative to another. In particular, where office chairs are concerned, the device may serve to laterally position chair arms relative to the chair seat at any of an arbitrarily chosen number of positions within a predetermined range (sometimes referred to as the "stroke"). It will appear clear from the subsequent specification that the device is not limited to use in chairs and articles of furniture but in many uses where reliable and economical structural adjustment is sought.

SUMMARY OF THE INVENTION

In a chair, the adjustment device comprises a bushing in sliding contact with a structural member. The bushings are maintained in sliding contact with the structural member of the chair arm by encasement within a support member and a retaining member. Two guide posts are installed thru holes in the retaining member, in sliding contact thru the elongated slot in the structural member and are fixedly attached to the support member. A number of spring washers are inserted around the guide posts, between the retaining member and one half of the bushing, to provide constant pressure of the bushing around the structural member. The support member, bushing and structural member assembly is held together and mounted to the underside of a chair seat by means of screws or bolts inserted thru peripheral mounting holes provided on the support member and matching similar holes on the retaining member. In this manner the structural member is free to slide the length of the elongated slot while held snugly within the bushing, the support member and the retaining member. The structural member is provided with blind holes arbitrarily spaced from one another and the elongated slot. The bushing is provided with a hole so that movement of the structural member within the bushing causes the hole in the bushing to selectively and concentrically align with the holes in the structural member. The support member is provided with a hole in concentric alignment with the hole in the bushing, and axially aligned with a hole provided for the attachment of one of the guide posts. A detente element is inserted thru the hole in the mounting member and the bushing so as to selectively seat within the blind hole on the structural member responsive to movement of the structural member. To insure that the detente element seats properly on the blind hole of the structural member, a flat spring is provided to maintain normal pressure on the detente element and is fitted with a hole for attachment to the threaded portion of the guide post by means of a nut. Thus, as the structural member slides relative to the bushing, support member and retaining member, the steel detente element partially descends into the blind hole(s) on the structural member, responsive to pressure from the flat spring, providing for a "detente" position at each of the blind holes. Thus, the chair occupant need only apply moderate manual force normal to the structural member to obtain desired lateral positioning of the arm relative to the chair.

The advantages of the adjustment device are numerous since it is possible for the chair occupant to remain seated while adjusting the lateral positions of the chair arms which can be accomplished without the use of specialized tools, built-in levers, or help from maintenance crews. Furthermore the device is simple to manufacture, install and conceal under the chair seat where it does not interfere with normal use of the chair.

BRIEF DESCRIPTION OF THE DRAWINGS

In order to better understand the features of the invention the following drawings of the preferred embodiment have been provided.

DETAILED DESCRIPTION OF THE PREFERRED EMBODIMENT AND OPERATION OF THE INVENTION

Figure 2:
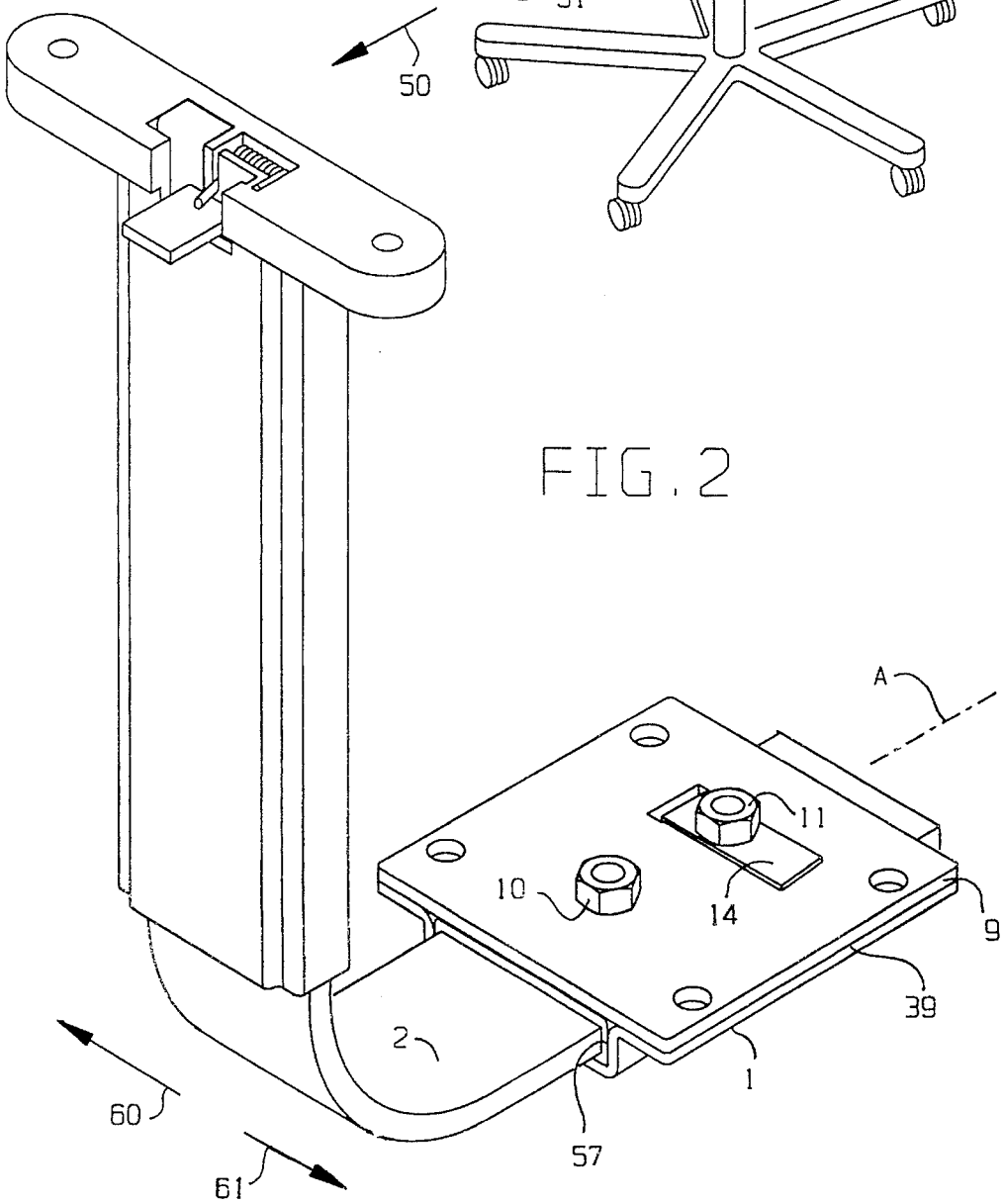
FIG. 2 is a detail perspective view of a part of the adjustable arm shown in FIG. 1 and includes the adjustment device.
Figure 3:
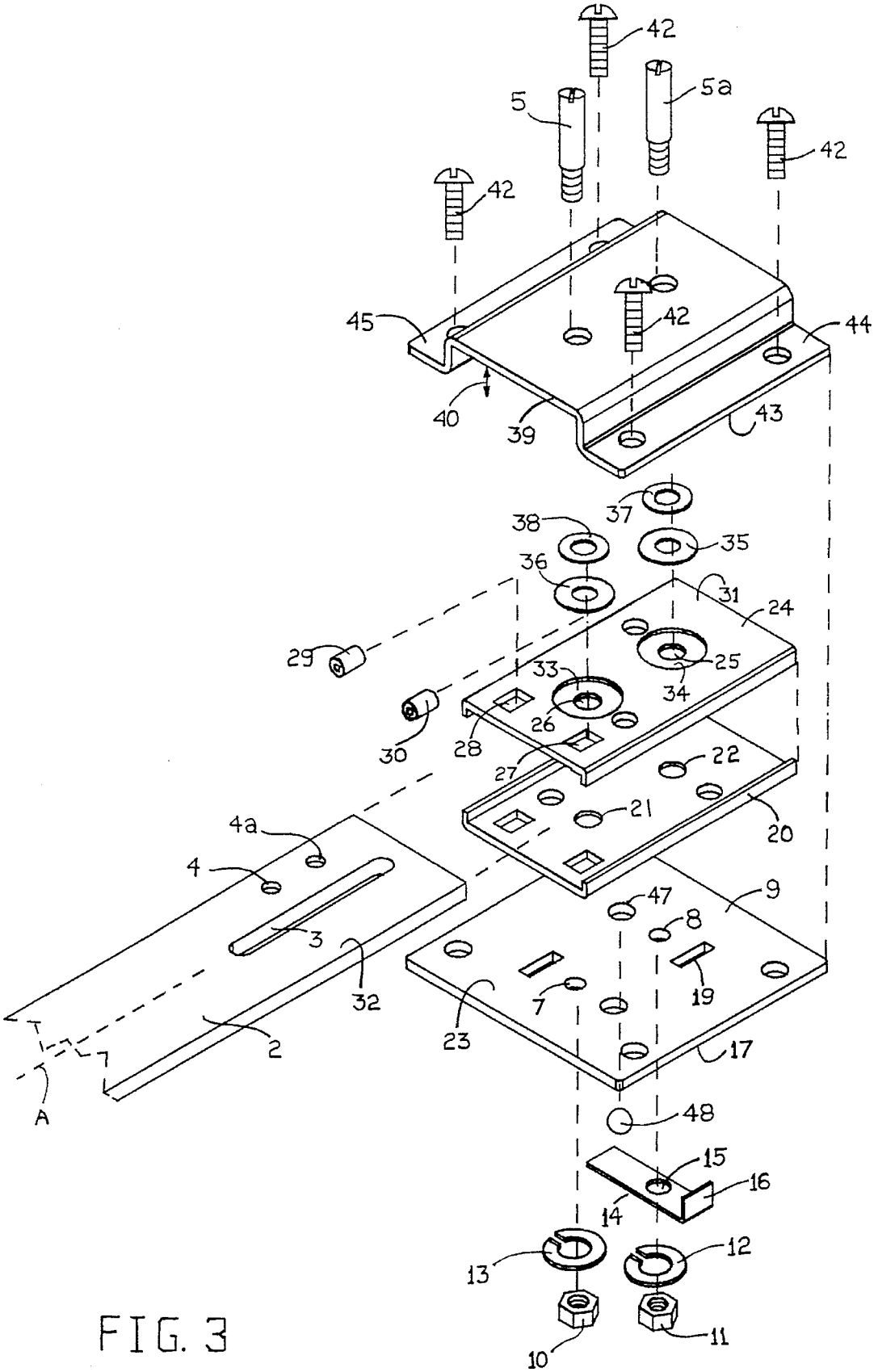
FIG. 3 is an exploded inverted view of the adjustment device and a partial view of the structural member.

The object of the invention can be achieved in an advantageous manner by the arrangement of the elements shown in the accompanying drawings of which the following are detailed descriptions:

Referring to FIGS. 2 and 3, an exploded view of a preferred form of adjustment device 1 is shown in FIG. 3 comprising structural member 2 provided with an elongated slot 3 for sliding guidance about guide posts 5 and 5*a*. Threaded portion 6 of said guide posts 5 and 5*a* is inserted thru holes 7 and 8 of support member 9 by means of nuts 10 and 11 and lock washers 12 and 13. Spring 14 is provided with hole 15 and flange 16. Spring 14 is inserted on threaded portion 6 of guide post 5*a* so that spring 14 is flat against surface 17 of support member 9 and is retained thereagainst by lock washer 12 and nut 11. Flange 16 of spring 14 is located within cavity 19 so as to insure correct and permanent orientation of spring 14 relative to support member 9. First bushing half 20 is inserted so as to engage guide posts 5 and 5*a* thru holes 21 and 22 on first bushing half 20, and is in flat contact with surface 23 of support member 9. Steel detente element 48 is inserted in hole 46 of first bushing half 20 and hole 47 of support member 9 and is prevented from movement beyond support member 9 by spring 14. Structural member 2 is inserted flat against first bushing half 20 so that slot 3 slidably engages guide posts 5 and 5*a* and holes 4 and 4*a* are able to engage detente element 48 responsive to axial displacement of chair structural member 2. Second bushing half 24 is inserted flat against structural member 2 so that holes 25 and 26 engage guide posts 5 and 5*a*. Second bushing half 24 is provided with cavities 27 and 28 to receive friction elements 29 and 30. Friction elements 29 and 30 are normally chosen to be of a flexible material resistant to abrasion and their external diameter is chosen to be such that a certain percentage of said friction elements 29 and 30 remains above upper surface 31 of second bushing 24 when said friction elements lie within cavities 27 and 28 and in contact with surface 32 of structural member 2. Two blind cavities 33 and 34 are located concentric with holes 25 and 26 of second bushing 24 to receive washers 35 and 36. Washers 35 and 36 provide stiff support for spring discs 37 and 38. Retaining member 39 is shaped so as to provide encasement of first bushing half 20, structural member 2, second bushing 24, friction elements 29 and 30, washers 25 and 26, and spring discs 35 and 36. Retaining member 39 is provided with throat depth 40 so that when retaining member 39 is attached to underside 41*a* of chair 41 by means of bolts 42, surfaces 43 of flanges 44 and 45 are in firm contact with surface 23 of support member 9, spring discs 38 and 37 are in compression and friction elements 29 and 30 are slightly deformed by compression.

Figure 4:
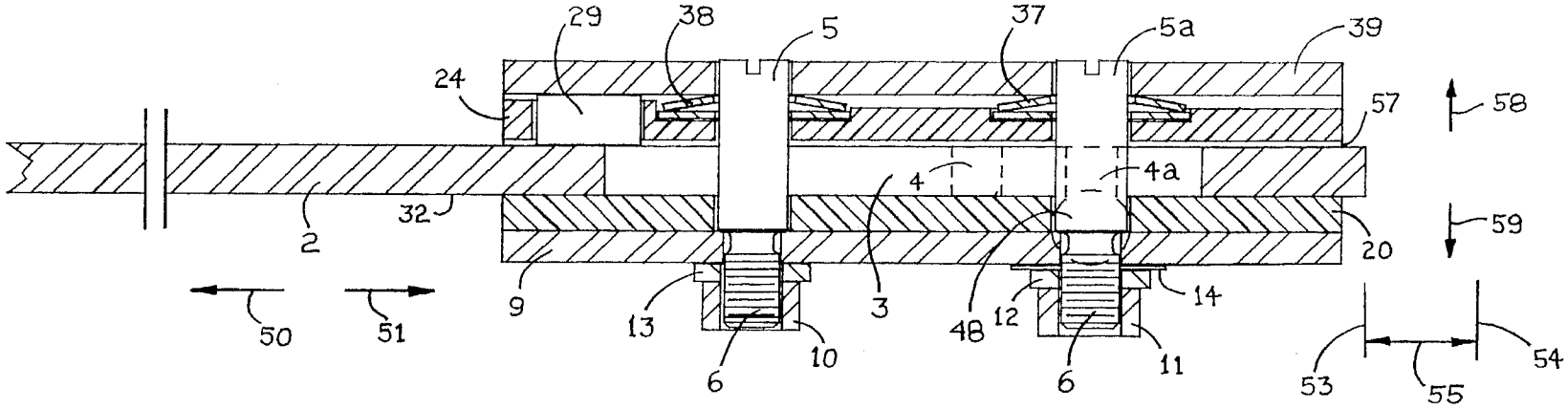
FIG. 4 is a cross section of the device along axis A of FIG. 2 and shows the device in one position.

Referring now to FIG. 4 it can be seen that structural member 2 is maintained in snug but sliding fit at all times relative to directions 58 and 59 and within cavity 57 formed by bushings 20 and 24 due to the pressure exerted by springs 38 and 33 while in compression between retaining member 39 and support member 9.

Referring now to FIGS. 2 and 3 it can be seen that structural member 2 is maintained in snug but sliding fit relative to directions 60 and 61 and within cavity 57 formed by bushing halves 20 and 24 due to the sliding fit maintained by the engagement of guide posts 5 and 5*a* within slot 3 off structural member 2.

Figure 1:
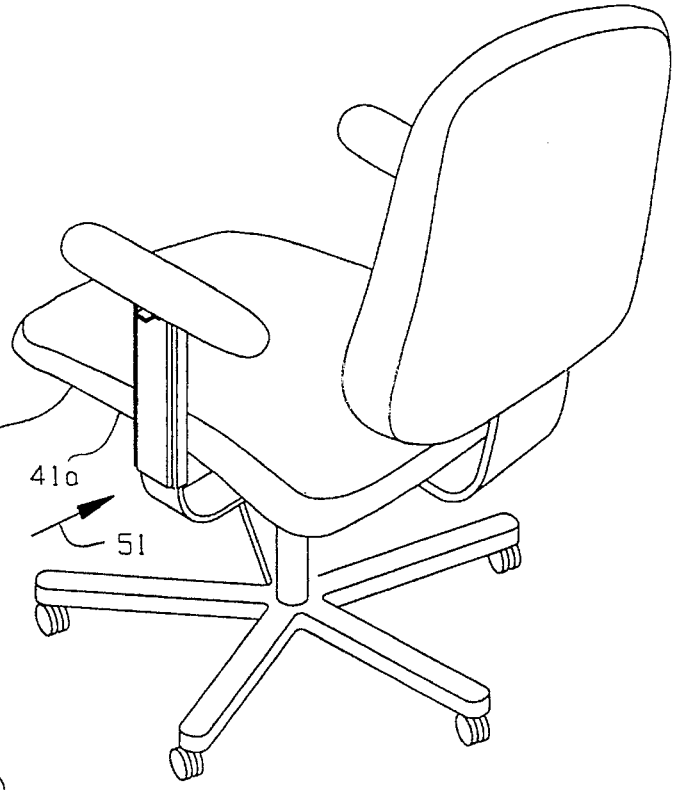
FIG. 1 is a perspective view of a typical office chair shown with arms installed with the adjustment device.
Figure 5:
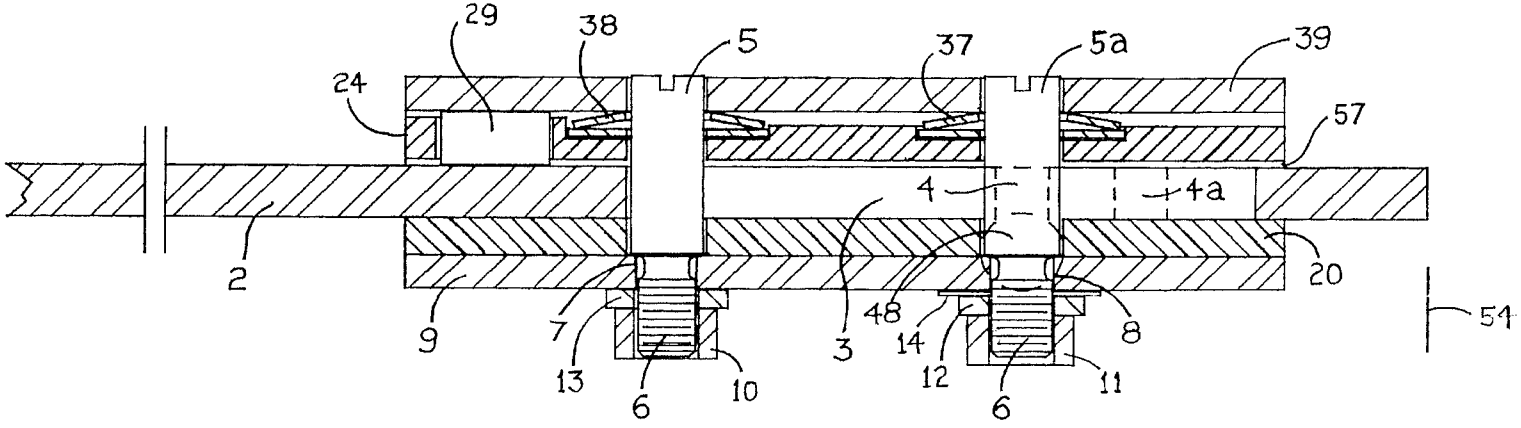
FIG. 5 is a cross section of the device along axis A of FIG. 2 showing the adjustment device in yet another position.

Referring now also to FIGS. 1 , 4 and 5, operation of adjustment device 1 is accomplished by manually displacing structural member 2 in a direction responsive to forces 50 or 51 so as to cause structural member 2 to move from a first position 53 to a second position 54. While structural member 2 is in first position 53 detente element 48 is seated on hole 4*a* of structural member 2 due to the force exerted on detente element 48 by spring 14. When force 51 is exerted upon structural member 2 which is sufficient to overcome the resistance offered by detente element 48 and spring 14, structural member 2 is able to displace a distance 55 in the direction of applied force 51 so that detente element 48 is pushed against spring 14 and will seat momentarily on surface 32 of structural member 2. When responsive to said force 51, said chair structural member 2 reaches position 54, and hole 4 is directly above detente element 48, spring 14 will cause detente element to seat in hole 4 providing a detente effect detectable by the chair user. Reverse operation is analogous when a force 50 is applied to structural member 2.

It is to be understood that adjustment device 1 is not limited to use in chairs, it being adaptable for use where it is necessary to releasably adjust the displacement of one member relative to another member. It will be apparent that many useful modifications of adjustment device 1 are possible without departing from the fundamental basis of the invention and the illustrations and examples provided herein are for explanatory purposes only and are not intended to limit the scope of the appended claims.

I claim:

1. An adjustment device comprising: a structural member, said structural member defining a slot, a support member, said support member in contact with said structural member, a retaining member, said support member and said retaining member encasing said structural member therebetween, a detente element, said detente element contacting said structural member for selective adjustable movement of said structural member along said support member, bushing means, said bushing means defining a guide post aperture, a guide post, said guide post passing through said guide post aperture, a friction element, said friction element contacting said bushing means and said structural member to slightly retard the movement of said structural element, said bushing means defining a receiving cavity, said receiving cavity for reception of said frictional element.

2. The adjustment device of claim 1 and including a detente element stop, said detente element stop attached to said support member.

3. The adjustment device of claim 1 wherein said support member defines a hole, said guide post positioned in said support member hole.

4. The adjustment device of claim 1 and including a tension member, said tension member attached to said support member.

5. The adjustment device of claim 1 wherein said bushing means comprises opposing first and second bushings halves.

6. An adjustment device comprising: a structural member, bushing means, said structural member slidably disposed within said bushing means, said bushing means comprising first and second opposing bushing halves, a support member, said support member in contact with said first bushing half, a detente element, said detente element positioned in contact with said support element, a retaining member, said retaining member in contact with said second bushing half, said structural member defining a post slot, a guide post, said guide post passing through said support member, said bushing means, said retaining member and said post slot, to allow slidable adjustment of said structural member along said guide post.

7. The adjustment device of claim 6 wherein said structural member defines a plurality of detente element apertures.

8. The adjustment device of claim 6 wherein said detente element is spherically shaped.

* * * * *